US007074108B2

(12) United States Patent
Knox

(10) Patent No.: US 7,074,108 B2
(45) Date of Patent: Jul. 11, 2006

(54) MULTI-LAYER UPLIFT BRA

(76) Inventor: Heather M. Knox, 3775 Northern Pike, Monroeville, PA (US) 15146

( * ) Notice: Subject to any disclaimer, the term of this patent is extended or adjusted under 35 U.S.C. 154(b) by 0 days.

(21) Appl. No.: 10/941,205

(22) Filed: Sep. 15, 2004

(65) Prior Publication Data

US 2006/0057936 A1 Mar. 16, 2006

(51) Int. Cl.
*A41C 1/00* (2006.01)

(52) U.S. Cl. ..... 450/1; 450/8

(58) Field of Classification Search ..... 450/1, 450/8, 10–17, 19–23, 30–32, 37, 39, 40, 450/49, 60–62, 65, 66–68, 70, 74–76, 79, 450/80, 82–84, 91–93, 41, 47, 48, 51, 52, 450/54, 55, 57; 2/67, 73, 78.1–78.4, 109, 2/110

See application file for complete search history.

(56) References Cited

U.S. PATENT DOCUMENTS 5,098,330 A * 3/1992 Greenberg ..... 450/55
5,873,767 A * 2/1999 Pickett ..... 450/1
6,165,047 A * 12/2000 Scott et al. ..... 450/55

* cited by examiner

*Primary Examiner*—Gloria M. Hale
(74) *Attorney, Agent, or Firm*—James Ray & Assoc.

(57) ABSTRACT

A multi-layer uplift bra which enhances a woman's natural curves while providing adequate support and coverage for the breasts includes a bottom portion capable of encircling the torso of a wearer, a pair of breast cups joined at a center portion, and a pair of straps, each of which being connected at one end to a breast cup and at another end to the bottom portion of the bra. The pair of straps are capable of extending over a pair of shoulders of the wearer. The breast cups include a first layer for lifting the breasts and creating cleavage and a second layer for supporting and holding the breasts in place. A joining means is provided for joining the first and second layers together along the bottom portion of the multi-layer uplift bra.

8 Claims, 3 Drawing Sheets

MULTI-LAYER UPLIFT BRA

FIELD OF THE INVENTION

The present invention relates, in general, to an improved uplift bra. More particularly, the invention pertains to a multi-layer uplift bra which enhances a woman's natural curves while providing adequate support and coverage for the breasts.

BACKGROUND OF THE INVENTION

A multitude of bra designs for various purposes such as cleavage enhancement, support, padding, and the like are well known in the art. Many of the cleavage enhancement bras known in the art have serious drawbacks which include the production of unsightly bulges of uncovered breast portions which make for an undesirable line underneath form fitting shirts. Another drawback of cleavage enhancement bras is that occasionally the breasts "fall out" of the bra which can cause embarrassment to the wearer. Additionally, some cleavage enhancement bras include padding therein to enhance the breasts of small to average breasted women. When women wearing these types of bras bend over, the bra often pulls away from the breast also causing embarrassment to the wearer. A drawback of so-called support bras is that in order to achieve the needed support and/or coverage for the wearer, the natural curves of the woman are often suppressed. As a result of the various drawbacks of these bras which are currently in use, some women have had to resort to wearing two separate bras at one time, one for breast enhancement and the other for support and coverage of the breast. The wearing of two separate bras can be uncomfortable and cumbersome as it requires the use of two separate attachment members, two separate elastic bands extending around the wearer's torso and dual straps on each shoulder. Additionally, the requirement of buying two separate bras which are worn at the same time can be cost prohibitive.

There is a need in the art to produce a bra which is capable of enhancing the natural curves and/or cleavage of a woman while providing sufficient support and coverage of the breast to avoid embarrassment to the wearer and to produce a smooth line beneath form fitting shirts.

OBJECTS OF THE INVENTION

It is therefore an object of the invention to produce a multi-layer uplift bra which enhances the cleavage of the wearer while properly supporting the breast.

Another object of the invention is to produce a multi-layer uplift bra which provides adequate coverage to the wearer and produces a smooth line beneath clothing.

Yet another object of the invention is to produce a multi-layer uplift bra which is comfortable to the wearer.

A further object is to produce a multi-layer uplift bra which capitalizes on the advantages of both cleavage enhancement bras and support bras in a cost efficient manner.

In addition to the objects and advantages listed above, various other objectives and advantages of the improved uplift bra disclosed herein will become more readily apparent to persons skilled in the relevant art from a reading of the detailed description section of this document. The other objects and advantages will become particularly apparent when the detailed description is considered along with the drawings and claims presented herein.

SUMMARY OF THE INVENTION

Briefly, and in accordance with the forgoing objectives, the invention comprises a multi-layer uplift bra which enhances a woman's natural curves while providing adequate support and coverage for the breasts. The uplift bra includes a bottom portion capable of encircling the torso of a wearer, a pair of breast cups joined at a center portion, and a pair of straps, each of which being connected at one end to a breast cup and at another end to the bottom portion of the bra. The pair of straps are capable of extending over a pair of shoulders of the wearer. The breast cups of the invention include a first layer for lifting the breasts and creating cleavage and a second layer for supporting and holding the breasts in place. A joining means is provided for joining the first and second layers together along the bottom portion of the multi-layer uplift bra.

DETAILED DESCRIPTION OF THE INVENTION

Figure 1:
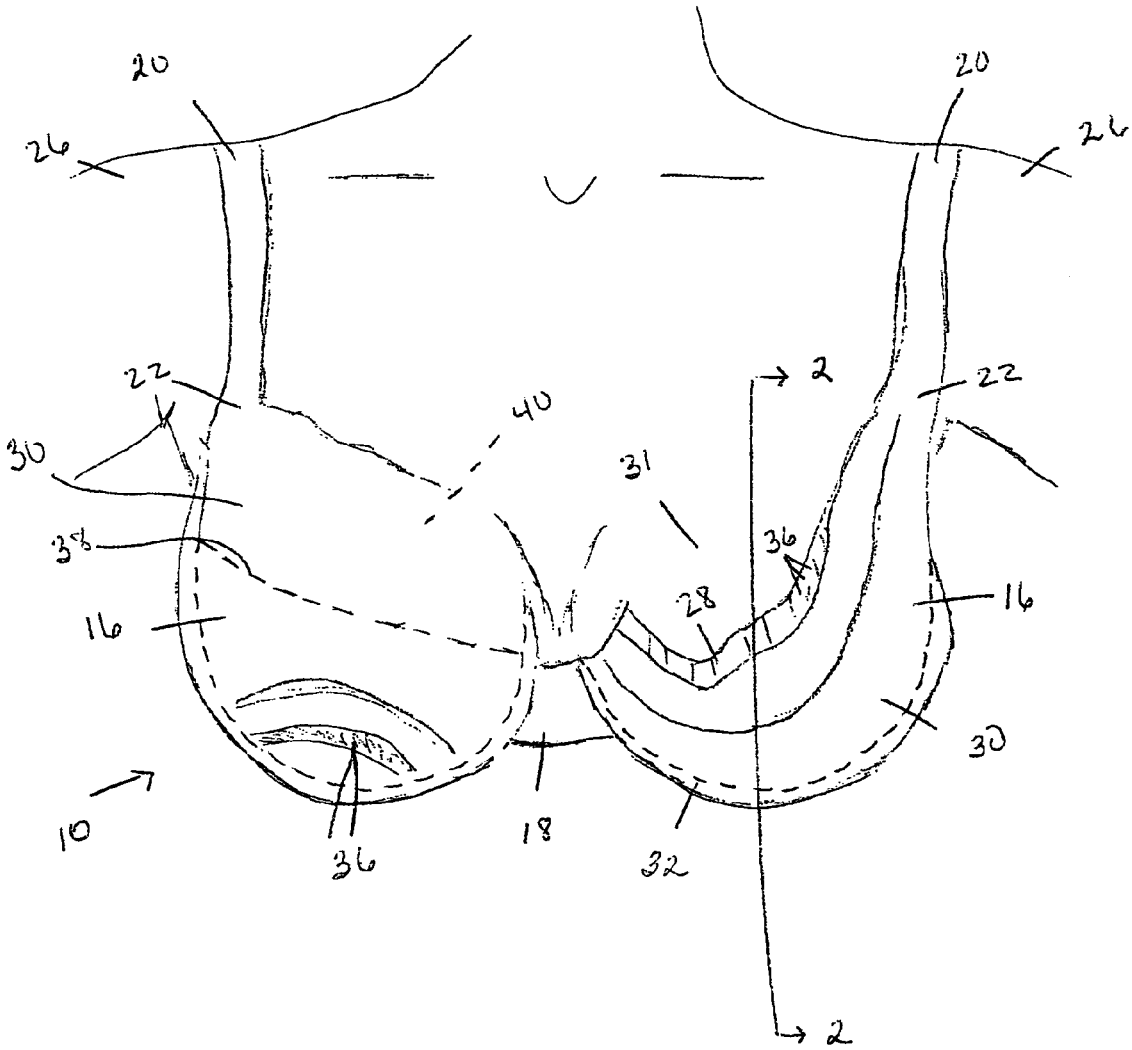
FIG. 1 shows a front elevation view with parts of the layers cut away to illustrate the multi-layer uplift bra constructed according to the invention.

Before describing the invention in detail, the reader is advised that, for the sake of clarity and understanding, identical components having identical functions have been marked where possible with the same reference numerals in each of the Figures provided in this document.

Figure 4:
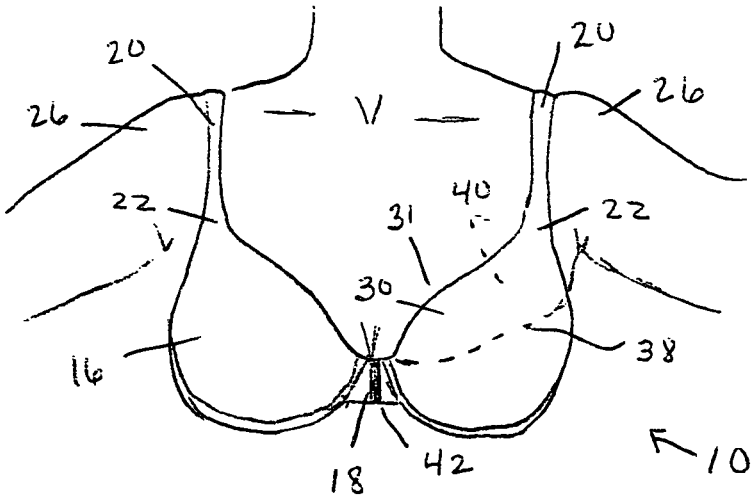
FIG. 4 shows a front elevation view of the multi-layer uplift bra of the invention.

Referring now to FIGS. 1 and 4, there is shown a front elevation view of the multi-layer uplift bra, generally illustrated as 10. The uplift bra 10 comprises a bottom portion 12 capable of encircling the torso of a wearer 14, a pair of breast cups 16 joined at a center portion 18, and a pair of straps 20 each of which being connected at one end 22 to a breast cup 16 and at another end 24 to the bottom portion 12 of the bra. The pair of straps 20 are capable of extending over a pair of shoulders 26 of the wearer.

Figure 2:
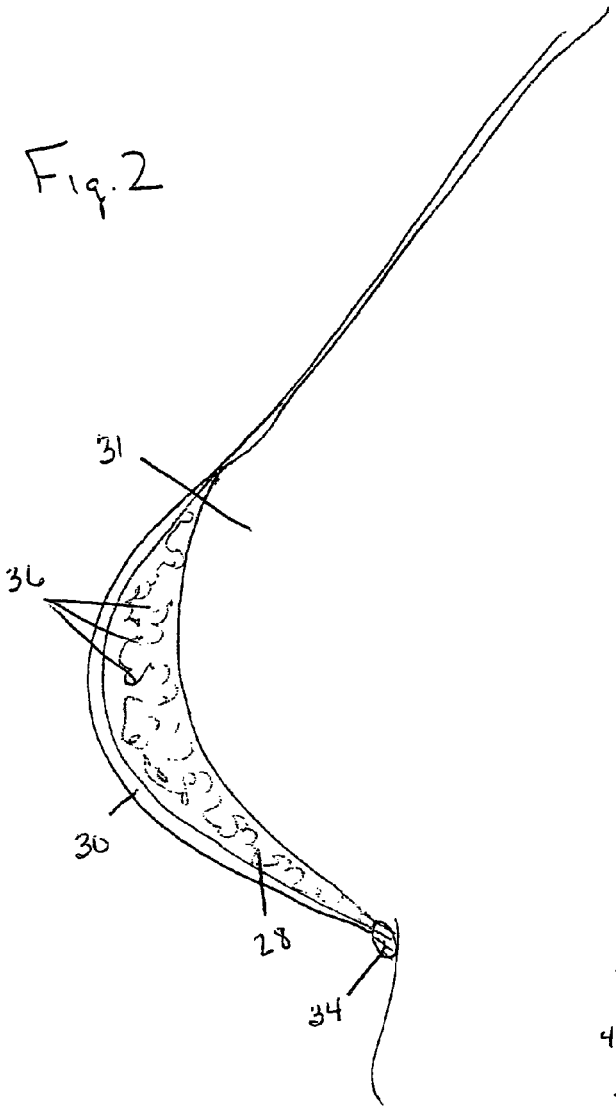
FIG. 2 shows a cross-sectional side view taken along line 2—2 of FIG. 1.
Figure 3:
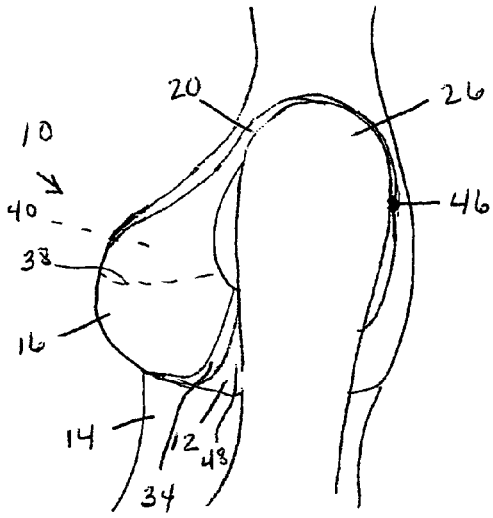
FIG. 3 shows a side elevation view of the multi-layer uplift bra of the invention.

Referring now more particularly to FIGS. 1–3 there is shown a first layer 28 for lifting the breasts and creating cleavage and a second layer 30 for supporting and holding the breasts 31 in place. A joining means 32 is provided for joining the first 28 and second 30 layers together along the bottom portion 12 of the multi-layer uplift bra 10. The joining means 32 can be any well known joining means such as sewing, fusing, gluing and the like.

The first layer 28, for lifting the breasts and creating cleavage, can be positioned adjacent to the breasts 31. This first layer 28 can include an under wire 34, padding 36 or a combination of an under wire 34 and padding 36 for creating cleavage and holding the breasts 31 in an upward and outward direction.

The second layer 30, for supporting and holding the breasts 31 in place, is positioned outside of the first layer 28. The second layer 30 extends over substantially the entire top edge 38 of the first layer 28. The second layer 30 extends in a vertical direction towards the straps parallel to the surface of the wearer's breast to hold the upper portion 40 of the breast 31 extending above the first layer 28 in place to reduce unsightly bulges and produce a smooth line to the breast 31. The second layer 30 can be formed from any well known material such as a smooth satin material, a lace material, or the like.

The first 28 and second 30 layers of the bra 10 are joined at the sides 48 of the breast cups 16 and at the connection point 22 of the breast cups 16 with the pair of straps 20.

Figure 5:
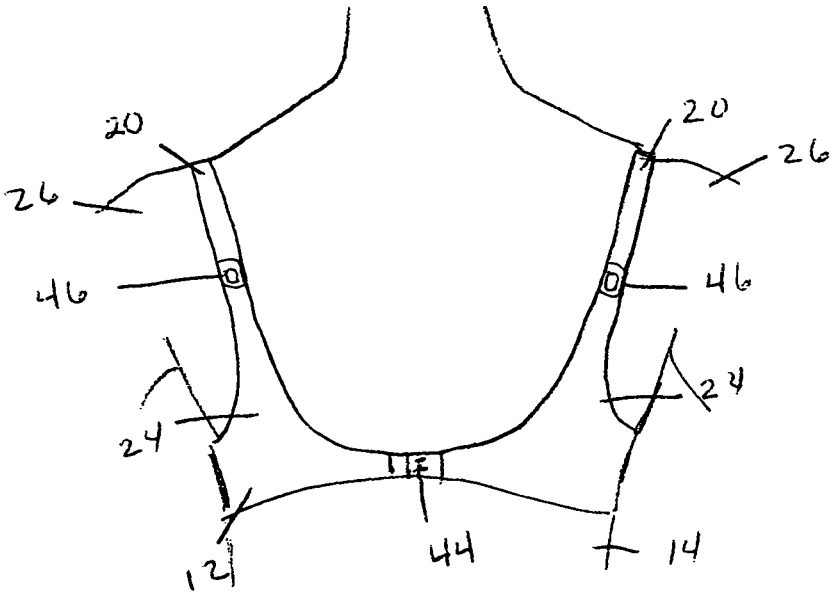
FIG. 5 shows a rear elevation view of the multi-layer uplift bra of the invention illustrating adjusting means and attachment means for the bra.

Now referring to FIG. 5, there is shown a well known clasp 44 for securing the bottom portion 12 of the bra about the torso 14 of the wearer. Alternatively, a front clasp 42, as shown in FIG. 4 may be provided for securing the bra 10 about the wearer such those well known in the art.

Additionally, as shown in FIGS. 3 and 5, the pair of straps 20 can include means 46 for making the straps adjustable in length about the shoulders 26 of the wearer. The adjusting means can be positioned in the front or the back of the wearer's shoulders 26.

Although the multi-layer uplift bra 10 of the invention has been described above as having a first layer 28, for lifting and creating cleavage, positioned adjacent the wearer's breasts 31 and a second layer 30, for supporting and holding the breasts 31 in place, being positioned outside of the first layer, it is not intended that the invention be limited in such a manner. The present invention can also include an embodiment wherein the second layer for supporting and holding the breasts in place can be positioned adjacent to the wearer's breasts and the first layer for lifting and creating cleavage can be positioned outside of this second layer. The degree of lifting, coverage, and support would not be effected by the order of placement of the layers with respect to the wearer's breast.

The invention has been described in such full, clear, concise and exact terms so as to enable any person skilled in the art to which it pertains to make and use the same. It should be understood that variations, modifications, equivalents and substitutions for components of the specifically described embodiments of the invention may be made by those skilled in the art without departing from the spirit and scope of the invention as set forth in the appended claims. Persons who possess such skill will also recognize that the foregoing description is merely illustrative and not intended to limit any of the ensuing claims to any particular narrow interpretation.

I claim:

1. A multi-layer uplift bra including a bottom portion capable of encircling the torso of a wearer, a pair of breast cups joined at a center portion, and a pair of straps each of which being connected at one end to a breast cup and at another end to said bottom portion of said bra, said pair of straps capable of extending over a pair of shoulders of such wearer, said multi-layer uplift bra comprising;

(a) a first layer positioned adjacent to the breast for lifting the breasts and creating cleavage;

(b) a second layer for supporting and holding said breasts in place positioned over said first layer and extending over substantially an entire top edge of said first layer, said second layer extending in a vertical direction towards the straps parallel to a surface of the wearer's breast to hold the upper portion of the breast extending above the first layer in place to reduce unsightly bulges and produce a smooth line to the breast and;

(c) joining means for joining said first and second layers together along said bottom portion of said multi-layer uplift bra.

2. A multi-layer uplift bra as recited in claim 1 wherein said first layer includes one of an under wire or padding for creating cleavage and holding said breast in an upward and outward direction.

3. A multi-layer uplift bra as recited in claim 1 wherein said first layer includes a combination of an under wire and padding for creating cleavage and holding said breasts in an upward and outward direction.

4. A multi-layer uplift bra as recited in claim 1 wherein said second layer is formed from one of smooth satin material and a lace material.

5. A multi-layer uplift bra as recited in claim 1 including one of a front or back clasp for securing said bottom portion of said bra about the torso of such wearer.

6. A multi-layer uplift bra as recited in claim 1 wherein said pair of straps includes means for making such straps adjustable in length about the shoulders of such wearer.

7. A multi-layer uplift bra as recited in claim 1 wherein said first and second layers are joined at the sides of said breast cups and at the connection point of said breast cups with said pair of straps of said multi-layer uplift bra.

8. A multi-layer uplift bra as recited in claim 1 wherein said joining means comprises one of sewing, fusing, and gluing.

* * * * *